US005118114A

United States Patent [19]

Tucci

[11] Patent Number: 5,118,114

[45] Date of Patent: Jun. 2, 1992

[54] METHOD AND APPARATUS FOR PLAYING A POKER TYPE GAME

[76] Inventor: Domenick Tucci, 3572 Spencer St., Las Vegas, Nev. 89109

[21] Appl. No.: 745,387

[22] Filed: Aug. 15, 1991

[51] Int. Cl.[5] ..... A63F 1/00

[52] U.S. Cl. ..... 273/274; 273/292; 273/138 R; 273/148 R

[58] Field of Search ..... 273/292, 148 R, 138 R, 273/145 C, 274

[56] References Cited

U.S. PATENT DOCUMENTS 2,601,985 7/1952 Yerkes ..... 273/138 R 5,013,049 5/1991 Tomaszewski ..... 273/292

OTHER PUBLICATIONS

Scarne's Encyclopedia of Games by John Scarne, pp. 33-46, Harper and Row, Publishers, 1973.

*Primary Examiner*—Benjamin Layno

*Attorney, Agent, or Firm*—Richard A. Joel

[57] ABSTRACT

A gaming arrangement includes a betting table, a random selection device for selecting the "Dealer's Spot" or hand and playing cards. The betting table is layed out in a system facilitating the betting rules of a new game known as Action Poker TM which automatically permits a player to know where he stands from an odd or no-pay standpoint after each card. The random selection device for selecting the Dealer's Spot comprises a clear plastic cylinder, having a ball located therein, a ball release mechanism and a plurality of various designated slots at the lower end of the cylinder to receive the ball when released and thus determines the dealer's hand.

3 Claims, 2 Drawing Sheets

METHOD AND APPARATUS FOR PLAYING A POKER TYPE GAME

BACKGROUND OF THE INVENTION

This invention proposes a new casino gambling game and apparatus known as ACTION POKER TM. Very few new gambling games have evolved and been approved by the gaming commissions where gambling is legal. Poker is a well known and popular game but the occassional gambler is turned off by the fact that there is an element of skill involved. The skill is difficult to acquire without considerable practice and as a consequence, many potential players steer clear of poker tables at casinos.

To overcome this gaming reluctance and to provide a fast-paced exciting variation on conventional poker, Applicant has developed an exciting poker game with predetermined payouts without the element of skill involved. Once the "Dealer's Spot" is established with a novel container apparatus, the dealer provides each player with a pair of cards face up which are then eligible for awards based on a predetermined game board which allocates awards according to the percentage that the house is to retain. Third, fourth and fifth cards are sequentially dealt to the players and awards or the lack thereof are announced after each round.

The game involves the players by permitting the players sequentially to determine the Dealer's Spot with a unique inexpensive apparatus. The game payback may be easily determined to draw players who it is expected will readily respond to a game which is fun and easy to play. The pay-backs are graphically displayed on a unique gaming board.

SUMMARY OF THE INVENTION

This invention relates to a new and unique method of playing a poker type game and a new and unique gaming apparatus comprising ball release means for selecting the "Dealer's Spot", betting table and playing cards. The means for selecting the "Dealer's Spot" comprises a clear plastic container having a ball located in the upper portion thereof, a ball release mechanism normally having the ball positioned thereon and a plurality of designated slots commencing at a central rubber buffer and extending downwardly to the periphery of the container. The slots are separated by dividers.

In operation, the clear sealed container is inverted with the ball release removed so that the ball drops into the upper part of the container. The transverse release member is inserted and the container turned right side up. The release member is then withdrawn and the ball drops into one of the numbered slots to provide the "Dealer's Spot" or hand.

To start, each player makes a wager in the bet circle on a game board. The dealer next deals each player two cards face up from an automatic shuffler having at least 2 decks. The dealer then evaluates each hand in accordance with the layout on the game board in front of each player. The dealer announces any awards and any "no pays". A third card is then dealt face up to each of the players and evaluated as before. The cycle is repeated for the fourth and fifth cards with the announcement of awards and "no pays" by the dealer.

Accordingly, an object of this invention is to provide a new and improved method of playing poker type game and apparatus.

A further object of this invention is to provide a new and improved apparatus for selecting a dealer's hand which is inexpensive and easy to use.

A more specific object of this invention is to provide a new and improved gaming apparatus which includes a container with removable release means for a ball which drops into one of a plurality of numbered slots to provide the "Dealer's Spot", a game board and cards which are dealt sequentially to provide designated awards which are in accordance with a predetermined payout.

BRIEF DESCRIPTION OF THE DRAWINGS

The above and other objects and advantages of the present invention may be more clearly seen when viewed in conjuction with the following drawings wherein.

DETAILED DESCRIPTION OF THE INVENTION

Figure 1:
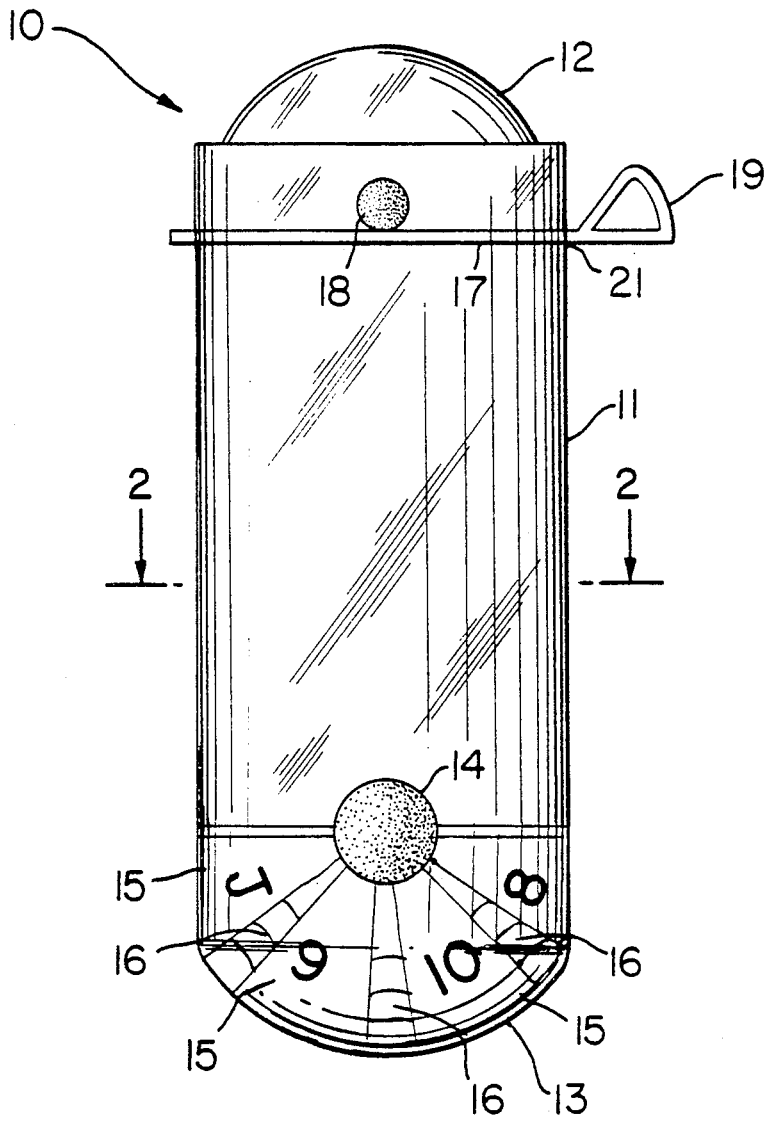
FIG. 1 is a front view of the container or "Bogey Jar" for determining the "Dealer's Spot" or hand.
Figure 2:
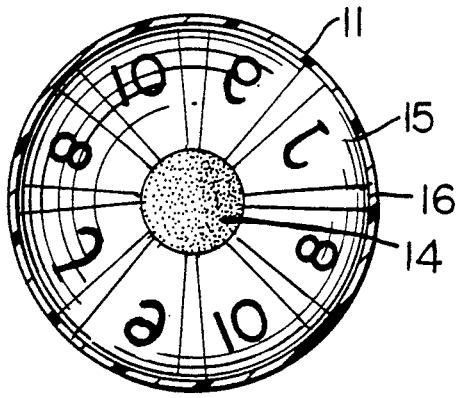
FIG. 2 is a cross-section taken along the line 2—2 of FIG. 1.
Figure 3:
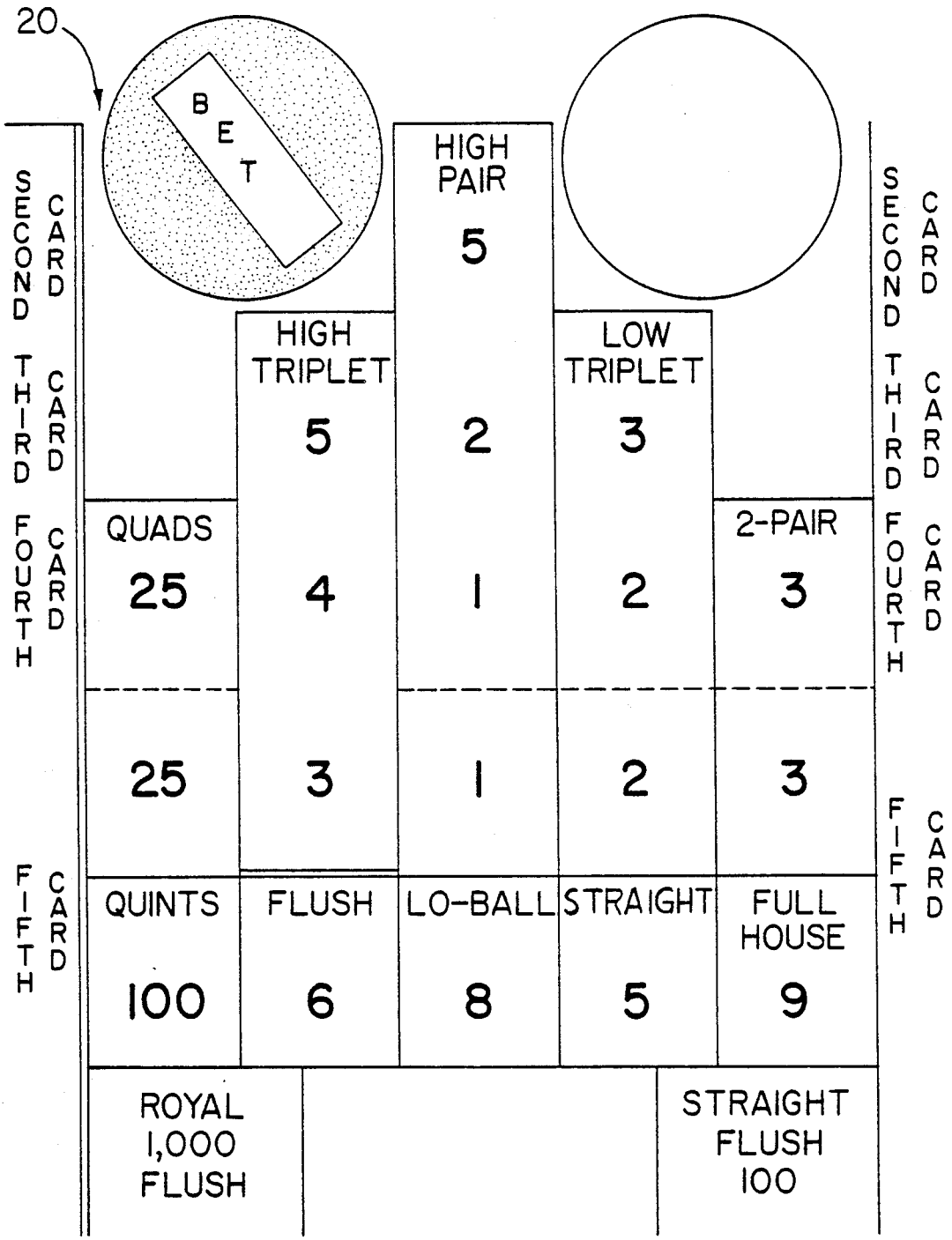
FIG. 3 is a plan view of the gaming board utilized in connection with the invention.

Referring now to FIG. 1 of the drawings, the invention comprises a clear plastic container 10 which includes a main tubular body portion 11, a rounded upper cover portion 12 and lower cover portion 13. The lower portion comprises a centrally located rubber buffer 14 and a plurality of card channels or slots 15 extending downwardly therefrom separated by dividers 16. There are a total of eight channels 15 which are designated 8, 9, 10 or Jack (two of each designation are employed).

A small rubber ball 18 is also enclosed within the containers 10 and is maintained in the upper portion of the body 11 by a transverse release member 17. The release member 17 extends through a slot 21 in the tubular portion 11 and includes a gripping portion 19 outside the container 10.

In operation, the container 10 is inverted so that the ball 18 drops into the upper cover 12. The release member 17 is inserted and the container 10 is righted. The release member 17 is then withdrawn dropping the ball downwardly to contact the rubber buffer 14 and drop into a slot comprising one of the card channels 15. The slot 15 where the ball 16 lands designates the house hand as a pair of whatever designation is on the slot 15.

The game is played with two or more 52 card poker decks or with a multiple deck shoe. The basic playing rules are the same for any number of decks but the statistics of hand distribution depend to some degree on the number of decks employed.

The playing table 20 comprises a layout which determines whether a hand is a winner, what the odds are for each card dealt to a player. The rewards for each hand are listed for the second through fifth cards or the hand can be a no-pay hand.

ACTION POKER TM, as the game is known, can be played by 1 to 6 players on a casino table similar in size and shape to a standard "21" table or by up to 9 players on a standard casino poker table. Variations on the game can be played in a video poker slot machine medium or as a television contestant game or even as a home entertainment game.

The game is banked by the dealer, acting for the "house". The pay schedule is established to favor the house, the percentage being pre-set to the level required by the house. The game does not need skill on the part of the players and the statistics are readily determinable so that the overall statistical payback is known in advance for any pay schedule.

In play, each player places a bet in his assigned bet circle 22. Using the Bogey Jar or container 10 as previously described, the value of the "Dealer's Spot" is established as an 8, 9, 10, or Jack. The value is posted during the hand.

Two rounds of cards are placed face up in front of each player. The players are not permitted to touch the cards. Any player who has a pair higher than the "Dealer's Spot" is paid according to the plan on the gaming board. After all awards have been paid, the game continues for the winners.

Each player is dealt a third card. The dealer makes awards to the players who have just made a pair higher than the "Dealer's Spot". In addition, awards are made to those players who just made Triplets of higher rank than the "Dealer's Spot" and smaller awards to players with lower ranked Triplets. All awards are paid to the respective winner's Award Circle, where they must remain until the hand is completed.

The same sequence is following for the fourth and fifth cards with the awards designated on the gaming board. At the end of the game, the players take their awards.

It is to be understood that the above-described arrangements are merely illustrative examples of the application. Numerous other arrangements may be readily devised by those skilled in the area which will embody the principles of the invention and fall within the spirit and scope thereof.

What is claimed is:

1. A gaming arrangement for a poker-type game involving a dealer and one or more players comprising:

means for determining the dealer's hand comprising a random selection apparatus having poker playing card designations for 8, 9, 10, or Jack, a clear plastic including a main tubular body portion a rounded upper cover portion and a lower cover portion, said lower portion including a plurality of slots having said poker playing card designations thereon and dividers separating said slots, a ball located within the container, means for dropping said ball into one of said slots so that the designation thereon comprises the dealer's hand, the lower portion includes a centrally located buffer having the slots extending downwardly therefrom and the means for dropping the ball comprising a retractable transverse member located within the container and having a handle outside the container, and said container includes a slot through which said transverse member may be retracted, a gaming board used in cooperation with the means for determining the dealer's hand, said board having predetermined awards designated thereon for each of four cards to provide a predetermined payout, and at least two decks of poker playing cards which are dealt to the players singly to measure against the award requirements on the gaming board.

2. A gaming arrangement for a poker-type game involving a dealer and one or more players in accordance with claim 1 further including:

a game board having designations for the second through the fifth card along the periphery thereof and the awards designated thereon for various hands at each card level.

3. The method of playing a poker-type game comprising:

providing a deck of paper playing cards, providing a sealed container having a plurality of designated slots at the lower end thereof, each slot being designated to represent a poker playing card value, a ball located therein in the upper portion thereof and release means for said ball, releasing said ball into one of said slots to determine the dealer's hand, and, providing a gaming board with award listings thereon dealing two cards face up on the gaming board to each player, determining whether the player is entitled to an award per the gaming board, sequentially dealing a third, fourth and fifth round of cards to each winning player, and, determining after each round whether a player is entitled to an award per the gaming board.

* * * * *